United States Patent [19]

Davis

[11] Patent Number: 4,894,938

[45] Date of Patent: Jan. 23, 1990

[54] FIRING PIN FORCE TRANSDUCER

[75] Inventor: William R. Davis, Harford County, Md.

[73] Assignee: The United States of America as represented by the Secretary of the Army, Washington, D.C.

[21] Appl. No.: 361,459

[22] Filed: May 30, 1989

[51] Int. Cl.[4] ..... F41C 31/04

[52] U.S. Cl. ..... 42/1.01; 73/167

[58] Field of Search ..... 42/1.01; 73/167, 12, 73/862.65

[56] References Cited

U.S. PATENT DOCUMENTS 4,342,223 8/1982 Smith ..... 73/167

4,726,135 2/1988 Adams ..... 42/1.01

OTHER PUBLICATIONS

W. R. Davis "Dynamic Stress Measurements of Sniper Rifle", Aug. 5, 1988.

*Primary Examiner*—Charles T. Jordan

*Assistant Examiner*—Michael J. Carone

*Attorney, Agent, or Firm*—Saul Elbaum; Paul Clohan

[57] ABSTRACT

A firing pin force transducer for use with firearms is disclosed. Impact of the firing pin on a simulated primer housed in a cartridge facsimile is transduced into an electrical signal by a foil strain gage and fed into a signal conditioner. The amplified signal is recorded by a digital oscilloscope allowing the operator to determine the force and energy expended by the firing pin.

4 Claims, 1 Drawing Sheet

FIRING PIN FORCE TRANSDUCER

RIGHTS OF THE GOVERNMENT

The invention described herein may be manufactured, used and licensed by or for the United States Government for Governmental purposes without payment to us of any royalty thereon.

BACKGROUND OF THE INVENTION

1. Field of the Invention

The present invention relates generally to force measurement devices, and specifically to devices for measuring the impact force and energy of the firing pin of a firearm on the cartridge primer.

2. Description of the Prior Art

In the operation of firearms, it is desirable to be able to measure the impact force and the impact energy of the firing pin on the cartridge primer. If the impact force is too small, the ammunition may not fire. If the impact force is too large, damage to the firearm may occur over extended periods of time. Additionally, the ability of the marksman to aim the weapon properly may be adversely affected. The impact energy of the firing pin on the primer is also important in that experience has shown that even when the impact force is high, some weapons may not fire if the impact energy (force/time) is too low, particularly at low temperatures.

Numerous devices have been designed to measure the effect of an impact on a test material. A known impact force can be applied to a test material to determine its properties under the effect of the impact. A method such as this could be used in reverse to estimate the magnitude of an unknown impact. A material of known characteristics could be impacted, and the effects as measured on the test material would indicate the magnitude of the impact force. One previous test method consisted of using copper or brass as the test material. However, this provided no measure of the time frame of the impact and was semi-quantitative. This method was also time consuming and laborious. Another method, discussed in U.S. Pat. No. 4,342,223, was to use an impact calibrator. Impact of the firing pin on a cartridge unit creates a voltage signal detectable by a calculator unit. The calculator unit computes and displays the impact force of the firing pin. This device does not, however, provide a force/time history of the firing pin impact on the primer.

OBJECTS AND SUMMARY OF THE INVENTION

An object of the present invention is to provide a device which is insertable in the firing chamber of a firearm and which can be used to detect not only the maximum impact force of the firing pin, but also the energy expended by the firing pin. According to one feature of the invention, a casing which is insertable into a firing chamber of a firearm is provided. A very small photoetched foil strain gage bonded upon a steel rod is disposed within the casing making it possible to record many points of the strain wave as it passes the strain gage. The steel rod is provided within the casing for transducing the force of the impact of the firing pin to the measurement equipment. A feature of the invention is that measurement error is reduced by the use of one steel rod for transferring the impact energy of the firing pin to the transducer as opposed to several elements utilized for this function in the prior art.

A further object of this invention is to provide an improved apparatus and method for computing not only the maximum impact force of the firing pin but also the energy expended by the firing pin. This is done by activating the firing pin mechanism with a cartridge facsimile in the firing chamber. A voltage signal which is proportional to the force of the impact is created by the transducer. This signal is then amplified by a signal conditioner and recorded on a digital oscilloscope. A feature of the invention incorporates a sophisticated laboratory instrument to fully record the force at a rate of one data point every 0.5 microseconds. The data is then graphed and the area under the graph is integrated to give the actual impulse energy expended by the firing pin in units such as pound-seconds.

A still further object of the present invention is to provide an apparatus which can be used for calibrating the impact force of a firing pin, which is accurate, can be reused indefinitely, is repeatable, and is easily operated. The instruments used in the present invention can be easily calibrated to give high accuracy in the readings of impact force and energy. The detecting device is contained in a cartridge facsimile, which can be used as often as desired as it is not destroyed by use. Operation consists merely of inserting the cartridge facsimile into the firing chamber and firing the firearm as if it were loaded with ammunition. The impact force and energy is then obtained from the attached instrumentation.

Yet another object of the present invention is to provide an apparatus which can be used on all types of firearms. The cartridge facsimile need merely be made a suitable size, thus the same cartridge facsimile can be used in all firearms having the same caliber.

The novel features which characterize the present invention are defined by the appended claims. The foregoing and other objects and advantages of the invention will hereinafter appear, and for purposes of illustration, but not of limitation, an embodiment is shown in the drawings.

DETAILED DESCRIPTION OF THE PREFERRED EMBODIMENTS

Figure 1:
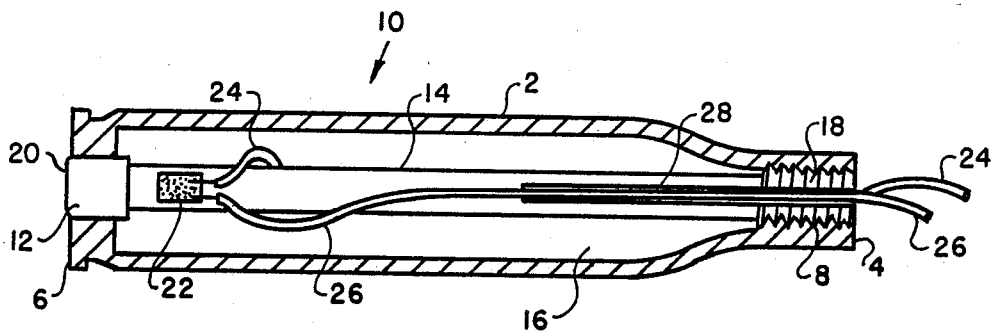
FIG. 1 is a sectional view of a device to be placed in the firing chamber of a firearm.

A preferred embodiment of the present invention is herein described in detail. Referring to FIG. 1, a firing pin force transducer 10 is designated generally by the number 10. The cartridge facsimile 2 fits slideably within a firing chamber of a firearm (not shown). In the present embodiment, the cartridge facsimile 2 is substantially the same size and shape as a shell casing of ammunition for the firearm.

The cartridge facsimile 2 has a forward end 4 and a breech end 6. Both the forward end 4 and the breech end 6 of the cartridge facsimile 2 have an aperture. The forward end aperture has cartridge threads 8 while the breech end aperture 12 is sized to be substantially the same as a cartridge primer. A rod 14 is disposed within the interior void 16 of cartridge facsimile 2. Rod 14 is fixedly attached by rod threads 18 to cartridge threads 8 at the forward end 4 of cartridge facsimile 2. At the other end of rod 14 is a simulated primer 20, an integral part of rod 14, which is movably disposed within breech end aperture 12 of cartridge facsimile 2 such that the force from a firing pin impacting upon the simulated primer 20 will be transmitted in a compressive manner upon rod 14. Rod 14 is cylindrical and a strain gage 22 is bonded very firmly to rod 14 near simulated primer 20 by means of a bonding cement such as Micromeasurements M-Bond AE-10/15, M-Bond GA-2, M-Bond 600 or M-Bond 610. An example of a suitable strain gage 22 is a Micromeasurements precision strain gage model EA-06-125BT-120. This strain gage has open-faced construction, a 0.03 mm flexible polyimide film backing, a resistance of 120.0 ohms, a gage factor of 2.065 and a $K_t$ of +0.4%. Electrical leads 24, 26 are attached to the ends of strain gage 22 by 63-37 Tin-Lead solder or 95-5 Tin-Antimony solder and exit the cartridge facsimile 2 through a slot 28 on either side of rod 14. Electrical leads 24, 26 will thus exit the firearm at the muzzle end and not interfere with the operation of th firing mechanism of the firearm.

Figure 2:
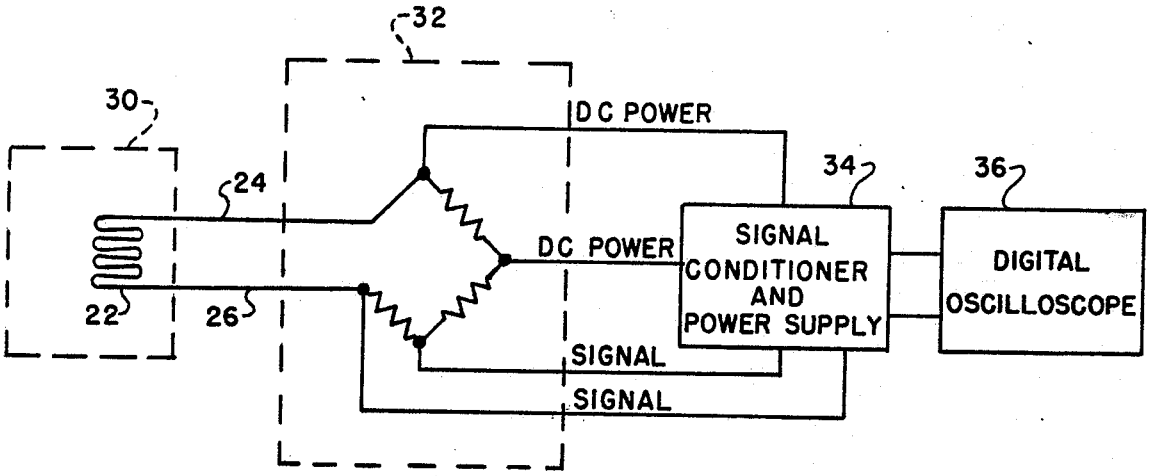
FIG. 2 is a block diagram of the electronic equipment used to measure the impact force and energy of the firing pin of a firearm.

Referring to FIG. 2 a block diagram of the firing pin force transducer 10 with measurement equipment is shown. A functional block for the cartridge facsimile with the transducer inside is enumerated as number 30. The function of the firing pin force transducer 10 as illustrated in FIG. 1 is used to illustrate the operation of the measurement equipment. Electrical leads 24 and 26 connect the measurement equipment to the cartridge facsimile 30. The strain gage 22 is wired into a wheatstone bridge 32 containing precision resistors. A small voltage differential is created across the output terminals of the wheatstone bridge 32 as a result of the change in resistance of the strain gage 22 caused by the impact of the firing pin on the cartridge facsimile 30. This small voltage differential is amplified by a signal conditioner 34, and the output of the signal conditioner 34 is fed into a digital oscilloscope 36. An example of a suitable signal conditioner is an Endevco Signal Conditioner with 100 kHz response. The signal amplitudes displayed by the digital oscilloscope 36 are converted into strain using the following equation:

$$E_oE=(F^*\epsilon^*10^{-3})/4$$

where:

$\epsilon$=Microstrain

F=Gage Factor

E=Supply Voltage $E_o$=Output Signal

The signal output is amplified fifty times by the signal conditioner 34 and the output values are divided by fifty before calculations are made. The values of microstrain are converted to stress (psi) using Young's modulus for steel of 29,500,000 psi. Stress is converted to loads (in pounds) by multiplying by the cross sectional area of rod 14 (FIG. 1). In order to obtain the energy expended by the firing pin on the cartridge facsimile 30, a digital oscilloscope having a 100 kHz minimum response and the capability of recording and displaying the rise time of the stress pulse and the area under the stress/time curve is needed. An example of a suitable oscilloscope is a Nicolet Model 4094A Digital Oscilloscope. The integration of the area under the stress/time curve will result in the energy expended by the firing pin.

To those skilled in the art, many modifications and variations of the present invention are possible in light of the above teachings. It is therefore to be understood that the present invention can be practiced otherwise than as specifically described herein and still will be within the spirit and scope of the appended claims.

I claim:

1. An apparatus for measuring the impact force and energy of a firing pin of a firearm, said apparatus comprising:

a substantially cylindrical cartridge facsimile insertable into the firing chamber of a firearm, said cartridge facsimile having a first and second end and an interior void;

said first end having in the center a smooth aperture and said second end having in the center a threaded aperture;

a rod disposed in said cartridge facsimile for transducing the mechanical effect of a firing pin impact to an electrical effect, said rod having a first and second end, said rod first end having a simulated primer and said rod second end having threads, said rod being anchored by said rod second end threads to said threaded aperture of said second end of said cartridge facsimile, said rod having a strain gage bonded near said first end of said rod;

said rod being made from steel;

means electrically coupled with said transducing mens for detecting the electrical effect of an impact of a firing pin in a firearm whereby the force and energy of a firing pin may be determined.

2. An apparatus for measuring the impact force and energy of a firing pin of a firearm, said apparatus comprising:

a substantially cylindrical cartridge facsimile insertable into the firing chamber of a firearm, said cartridge facsimile having a first and second end and an interior void;

said first end having in the center a smooth aperture and said second end having in the center a threaded aperture;

a rod disposed in said cartridge facsimile for transducing the mechanical effect of a firing pin impact to an electrical effect, said rod having a first and second end, said rod first end having a simulated primer and said rod second end having threads, said rod being anchored by said rod second end threads to said threaded aperture of said second end of said cartridge facsimile, said rod having a strain gage bonded near said first end of said rod;

said strain gage comprising an open faced construction strain gage having a 0.03 mm flexible polyimide film backing, said strain gage also having a resistance of 120 ohms, a gage factor of 2.065 and a $K_t$ of +0.4%;

means electrically coupled with said transducing means for detecting the electrical effect of an impact of a firing pin in a firearm whereby the force and energy of a firing pin may be determined.

3. A method for determining the impact energy of a firing pin in a firearm consisting of the steps of:

impacting the firing pin of a firearm against a device which exhibits a change in resistance proportional to the force of the impact;

detectinng the change in resistance at a rate of one data point every 0.5 microseconds;

recording the data;

creating a graph of the data;

integrating the area under the graph to give the actual impulse energy of the firing pin.

4. The method of claim 3 wherein the creating a graph of the data and integrating the area under the graph is done automatically by a digital oscilloscope.

* * * * *